United States Patent [19]

Roe et al.

[11] 4,006,289

[45] Feb. 1, 1977

[54] ELECTROMECHANICAL CABLE DEPLOYABLE IN A NO-TORQUE CONDITION, AND METHOD

[75] Inventors: Norman P. Roe; Gordon W. Brown, both of Idyllwild, Calif.

[73] Assignee: Consolidated Products Corporation, Idyllwild, Calif.

[22] Filed: Nov. 18, 1974

[21] Appl. No.: 524,665

Related U.S. Application Data

[63] Continuation-in-part of Ser. No. 497,872, Aug. 16, 1974, abandoned.

[52] U.S. Cl. ..... 174/102 R; 174/107; 174/108; 174/115; 174/131 A

[51] Int. Cl.[2] ..... H01B 17/22

[58] Field of Search ..... 174/108, 130, 131 A, 174/115 R, 113 C, 110 R, 102 R, 107, 114 S, 116; 242/159, 170, 171; 57/139, 145, 146, 147, 148, 152

[56] References Cited

UNITED STATES PATENTS

| | | | |
|---|---|---|---|
| 1,705,913 | 3/1929 | Gilbert | 174/107 X |
| 2,509,894 | 5/1950 | Toulmin, Jr. et al. | 57/147 |
| 2,589,507 | 3/1952 | Noyes | 174/131 A |
| 2,870,311 | 1/1959 | Greenfield et al. | 174/115 UX |
| 3,259,684 | 7/1966 | Wakefield | 174/107 X |
| 3,261,907 | 7/1966 | Morrison | 174/115 |
| 3,522,699 | 8/1970 | Popradi | 57/145 |
| 3,584,139 | 6/1971 | Swanson | 174/115 X |
| 3,717,720 | 2/1973 | Snellman | 174/131 A |
| 3,798,350 | 3/1974 | Clarke | 57/145 |
| 3,842,584 | 10/1974 | Schmittman | 57/146 |

*Primary Examiner*—Arthur T. Grimley

[57] ABSTRACT

An electromechanical cable is adapted for deployment along a generally straight path and when thus deployed to be substantially free of torsional reactions resulting from changes in tensile stress in the longitudinal direction of the cable. The cable includes a plurality of strain members arranged in an annular configuration. When the cable lies straight and untwisted the strain members are also straight, parallel to the longitudinal axis of the cable and parallel to each other. The strain members are loosely confined within the cable structure so that when the cable is subsequently twisted they are free to move into helical positions relative to the axis of the cable.

The cable is first wound into a coil and concurrently pretwisted about its own axis by approximately 360° for each loop of the coil. After being transported to the deployment site, the cable is pulled off the coil without relative rotation between the delivered end of the cable and the coil, so that the pretwist of the cable is relieved. The cable is then ready to carry a varying longitudinal tensile load without inducing significant torque or twisting action.

In one form of the invention the strain members are sandwiched between a sheath and an insulated core. In another form of the invention the strain members are disposed centrally of the cable and constitute a part of its inner core.

36 Claims, 15 Drawing Figures

ELECTROMECHANICAL CABLE DEPLOYABLE IN A NO-TORQUE CONDITION, AND METHOD

RELATED PATENTS

The present invention is a continuation-in-part of our copending application Ser. No. 497,872 filed Aug. 16, 1974 assigned to the same assignee and entitled —COILED ELECTROMECHANICAL CABLE —and now abandoned. Filed concurrently with this application is our application Ser. No. 524,643 entitled "METHOD AND APPARATUS FOR FORMING A SHEATHED ELECTRICAL CABLE" which is also assigned to the same assignee as the present application.

BACKGROUND OF THE INVENTION

This invention relates generally to an electromechanical cable that is especially adapted for antitorsional deployment along a generally straight trajectory.

In dealing with electromechanical cable there is a close interdependence among the method of manufacture and the cost thereof; the method of packaging and transporting the product; the method of deploying the product in the field; and the requirements imposed upon the cable when it is in use in terms of electrical, mechanical and chemical characteristics. In manufacturing the cable it is necessary that it be wound upon a drum, or into a coil, or the like, in order to later transport it to its location of use. The cable is then unwound from its drum or coil in conjunction with its deployment. Thus the attributes of the cable which may be desired for purpose of its use are limited not only by the available techniques of manufacture and the costs associated therewith, but also by the engineering design requirements and criteria for winding up or coiling the cable in the first instance as well as for unwinding or uncoiling it when it is subsequently deployed.

Where electrical cables extend for short distances or are fully supported, the basic requirement is simply to provide a coating of insulation around each conductor wire. This type of construction is used extensively, for example, in household extension cords for appliances, telephone instruments, and the like.

Some types of construction involve long lengths of cable in which, nevertheless, the cable is well protected. This is true when the cable is placed inside a rigid metal conduit, or buried in a ditch or trench, or laid within an underground tunnel. Such applications impose little in the way of longitudinal tensile load upon the cable, and also require little in the way of "armoring" for the cable to protect itself from its environment.

But in other construction situations the requirements may become severe, and these requirements are discussed under the following headings:

A. Longitudinal support. The cable may be suspended for great distances, either horizontally or vertically, either in air or in water. A considerable longitudinal tensile stress is placed upon the cable in order for it to support itself. Since the conductors are generally made of copper or other soft metal, it is necessary to provide in addition to the conductors one or more members having a high tensile load capacity and which may be referred to as "strain members". The strain members are often made of steel but also may be made of various other materials.

B. Armoring. Mechanical protection of the cable from its environment may require full or partial surrounding of the conductors with a mechanical structure which will resist a cutting or piercing action from the outside of the cable, or a bursting action of the cable itself. The "armoring elements" of a cable may be identical to the "strain members", or may be largely separate from them, or perhaps totally separate from them.

C. Chemical Protection. In any type of environment to which the cable is subjected it will require some degree of chemical protection. This requirement is perhaps greatest for submarine cables that are submerged in the ocean and continuously exposed to salt water and to ocean organisms.

D. Freedom from Torsion. The breakage of electrical cables resulting from kinkage has often been a problem. It has been well-known that the variation in the longitudinal tensile load upon a cable, whether it be an increase or decrease in the stress, may tend to cause the cable to twist in one direction or the other. Hence it is desirable to construct the cable in such a way as to avoid this problem.

For transportation and deployment, the method in common usage has been to wind the cable upon a drum or spool at the factory, and then transport the loaded drum to the place of deployment. This procedure involves rotating the drum about its axis in the first instance when the cable is being wound upon it, and then rotating it about its axis again at the development site. Depending upon the diameter and length of the cable, the loaded drum can become very bulky and heavy. Development of the cable then requires a considerable amount of power, and is also very slow and time-consuming because it is not feasible to rotate the loaded drum rapidly.

It has long been known that one way to make a cable easier to bend, and hence easier to wind upon a drum, is to construct it with armor or strain members all of which are helically wound about the cable in the same direction. The winding of the cable upon the drum stretches the strain members at the outer surface of the cable while compressing them on the inner surface of the cable, but because of the helical winding each strain member lies on the inner and outer surfaces alternately, with the result that the stretching and compressing forces offset each other. While such a cable construction is very satisfactory for purposes of transporting and deploying the cable, it does not usually meet the requirements for the end use of the product. The difficulty is that the helical wind of the strain members produces a torsional effect. Every time longitudinal tension on the cable increases, or the cable becomes slack, it tends to twist, and may then kink and break.

In the construction of submarine cables it is well-known to place the electrical conductors in the interior portion of the cable and surround them with metal armoring elements which provide both mechanical protection and longitudinal tensile support. These armoring elements are commonly constructed in two approximately equal portions which are helically wound in opposite directions. When the longitudinal tensile stress upon the cable varies, the torsional force developed from armoring elements wound in one direction is offset by the torsional force developed from those wound in the other direction. The technique of balancing the twisting forces is described, for example, in U.S. Pat. No. 3,374,619. Cables constructed in this fashion have no significant tendency to twist up and kink. They are deployed by unwinding from a loaded drum which is rotated about its axis.

In the prior art there has been a known technique for deploying a wire or cable without the necessity of rotating the coil or roll. To achieve this result the wire or cable must be pretwisted as it is being wound into the coil or roll. During deployment, pulling the wire or cable out straight from the stationary coil relieves the pretwist, so that the wire or cable is deployed in a straight and untwisted condition. This technique is described, for example, in U.S. Pat. No. 2,709,553 to Wellcome. However, it has not been known to apply this method to electromechanical cables that contain high tensile strain members as well as conductors.

The problem to which the present invention is directed is to deploy a cable into the ocean by pulling it from a small, relatively stationary coil or pack, and yet after the cable is deployed to have it be free of torsional effects. Thus, the cable in use must not have a tendency to twist, kink or break as a result of changes in the longitudinal tensile load on the cable.

Among the relevant prior art patents are U.S. Pat. No. 3,006,792 to R. Monelli and U.S. Pat. No. 3,115,542 to G. Palandri et al.

SUMMARY OF THE INVENTION

It is the object of the present invention to provide an antitorsional electromechanical cable which following manufacture thereof may be twisted and then untwisted in conjunction with its deployment along a generally straight trajectory and when thus deployed will be substantially free of torsional reaction resulting from changes in stress in the longitudinal direction of the cable.

According to the invention, longitudinally extending strain members are provided within the cable structure and loosely confined therein so they they are free to move, both circumferentially and longitudinally, whenever the cable is twisted or untwisted.

According to one form of the invention, the cable includes an insulated core composed of one or more electrical conductors, which may be in either a twisted or an untwisted state when the cable is first manufactured; a plurality of longitudinal strain members in the form of wires or fibers or strands of high tensile strength, arranged circumferentially about the cable core, with some circumferential spacing between them, in parallel relation relative to each other and to the longitudinal axis of the core; and an outer protective sheath of thermoplastic material having a high tensile strength extruded about the exposed surfaces of the strain members.

According to another form of the invention, the central core of the cable includes a plurality of strain members loosely spaced relative to each other so they can be twisted, and extending longitudinally of the cable and parallel to its axis. An outer protective sheath encloses the electrical conductors which are sandwiched between the cable core and the outer sheath.

The strain members of the present invention are in the form of individual wires, fibers or threads or filaments, made of a material composed preferably of steel, multi-mono filaments of aramid (Kevlar Trademark of E. I. DuPont de Nemours), graphite, polyester, glass or nylon, or strands or bundles thereof, but the invention is in no manner limited thereto so long as the strain members are of a suitable type having a high tensile strength.

The thermoplastic material which may be utilized is, for example, any suitable type of poly-vinyl chloride, poly-urethane or an extruded plasticized nylon, but as will be appreciated, the invention is not limited to the use of such material.

In the preferred method of deployment the cable is wound into a coil, and is also twisted approximately 360° for each revolution loop of the coil. When desired, it is possible to pull the free end of the cable from the coil without any concurrent torsional reaction of the free end with respect to the roll, and this method of pulling the cable causes the latter to untwist as it is paid out from the coil or roll along a generally straight path.

An important advantage of the invention is that deployment of the cable does not require rotating the cable roll or pack and the deployment of the cable alone involves relatively low inertia levels and hence may be started or stopped rather quickly.

DRAWING SUMMARY

FIG. 2 is an end view of the cable coil of FIG. 1;

PREFERRED EMBODIMENT

Reference is now made to FIGS. 1 through 6, inclusive, of the drawings illustrating the presently preferred form of the invention.

Figure 3:
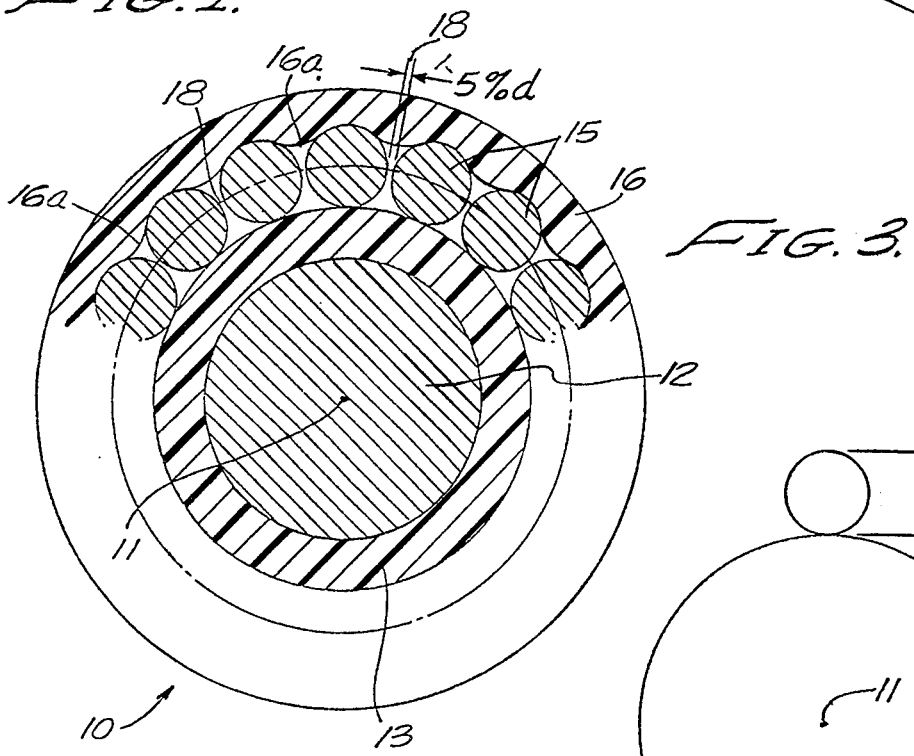
FIG. 3 is a transverse cross-sectional view of the cable used in the coil of FIG. 1.

A cable 10 has a longitudinal axis 11 (FIG. 3). A conducting core 12 is of cylindrical configuration and may be made of copper, soft steel, or semi-hard steel, and may if desired have an electrically deposited surface coating of silver or tin or some other metal to improve its electrical conductivity. Longitudinal axis 11 of the cable 10 is also the exact center of the conducting core 12. A layer of insulating material 13 surrounds and covers the conducting core 12.

A plurality of steel armor wires 15 are circumferentially disposed about the conducting core 12 and its insulating cover 13. A protective sheath or coating 16 encompasses and covers all of the armor wires 15.

Figure 4:
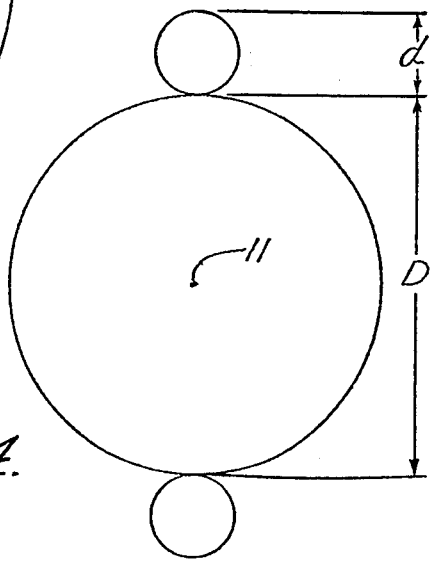
FIG. 4 is a schematic diagram of relative diameter values.

FIG. 4 is a schematic diagram showing relative diameter values. In FIG. 4 the symbol D is used to indicate the diameter of the insulated conducting core assembly, which includes both the conducting core 12 and its insulation cover 13. The symbol d is used to indicate the diameter of a individual one of the steel armor wires 15. In the particular illustration as shown in FIG. 4 the diameter d of the armor wire is only about one-fifth the diameter of the complete core assembly D. In the particular illustration shown in FIGS. 3 and 4 there are nineteen of the armor wires 15 and only one of the core conductors 12.

Figure 5:
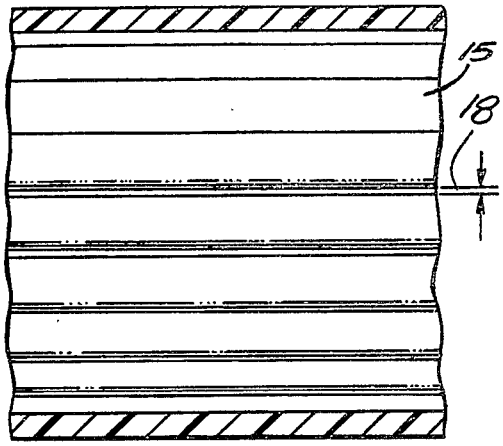
FIG. 5 is a side view, partially in cross-section, of the cable of FIG. 3 in an untwisted state.
Figure 6:
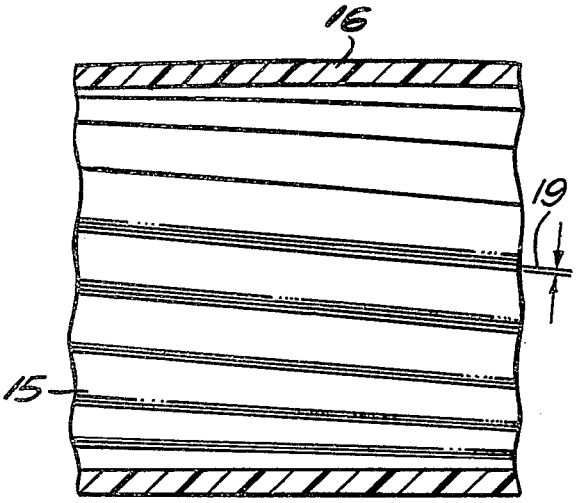
FIG. 6 is a side view, partially in cross-section, of the cable of FIG. 3 in a twisted state.

FIG. 3 is a cross-sectional view of the cable 10 in its untwisted state. Between each of the two adjacent ones of the armor wires 15 there is a circumferential space 18 which may, for example, be five percent (5%) of the diameter d of an individual armor wire 15 and is preferably at least one percent (1%). FIG. 5 is a side view of the cable in its untwisted form and the circumferential space 18 is visible in FIG. 5 in its full magnitude. When the cable is twisted, however, the circumferential space between adjacent armor wires diminishes. The diminished space 19 is shown in FIG. 6. Depending upon the amount of twisting of cable, the diminished space 19, may, of course, diminish to zero.

It is not necessary that space 18 exist between each two adjacent wires 15, but it must exist between at least some of them, so that the armor wires can shift circumferentially when the cable is twisted.

Figure 1:
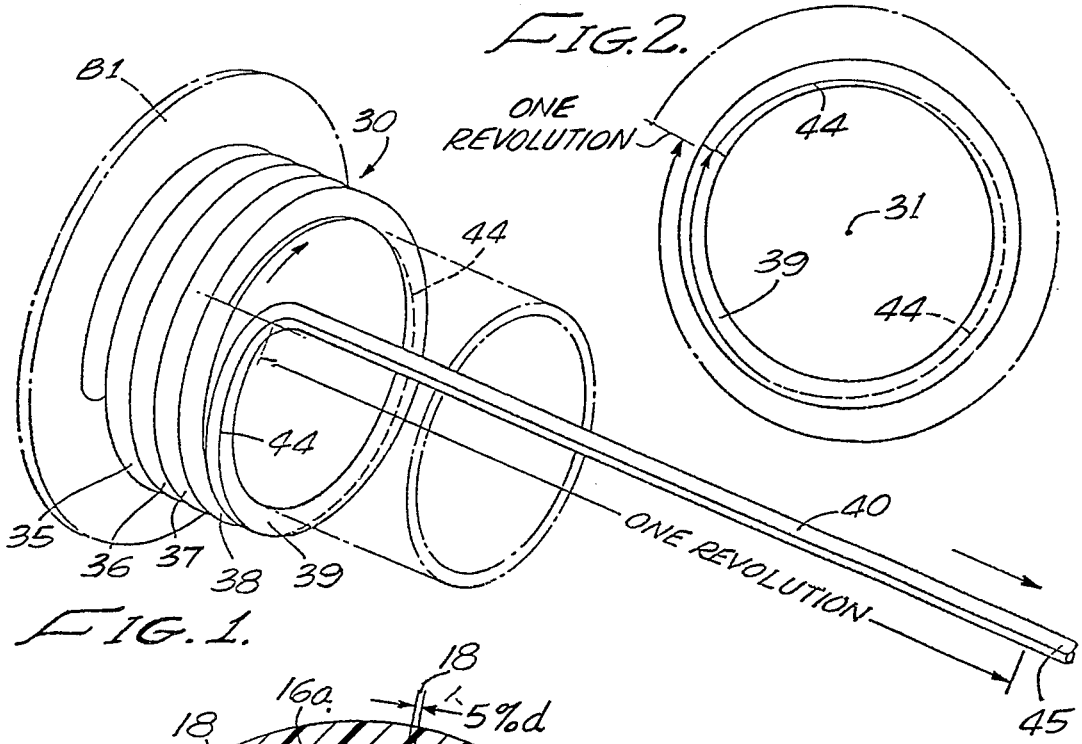
FIG. 1 is a perspective view of a coiled electromechanical cable in accordance with the present invention.

FIG. 1 shows a cable roll 30 made up from the cable 10 of FIG. 3. Roll 30 is supported from a base B1, and more specifically, an otherwise free end of the roll is held fast to the base. The cable roll 30 has a longitudinal axis 31 as best seen in FIG. 2. Individual coiled loops of the cable roll 30 are designated by reference numerals 35, 36, 37, 38, 39. Another complete loop 40, shown in the illustration of FIG. 1, has already been paid out from the roll. Loop 40 is connected directly to the free end 45 of the cable.

When the roll 30 is formed, the cable is concurrently pretwisted approximately 360° for each complete loop of the roll. In deploying the cable, however, it is only necessary to grasp the free end 45 and then pull it in a direction parallel to the longitudinal axis 31 of the roll 30, and while doing so to prevent the free or delivered end from rotating relative to the roll.

This may be accomplished by leaving the roll stationary and pulling the cable straight out from it. This results in the cable untwisting one twist per loop so that the pretwist is relieved and the cable is deployed in a completely straight and untwisted state. This relationship is graphically illustrated in FIG. 1 where a third solid line has been added to the paid out loop 40 in order to show an untwisted state of the cable. In the last loop 39 which still remains on the roll, an indicator line 44 is shown which is partially solid and partially dotted. The indicator line 44 also appears in FIG. 2 which is an end view of the cable loop 39. The purpose of the indicator line 44 is to show that the rotational orientation of the cable changes progressively around the circumference of the loop 39, so that where the ends of the loop meet (see FIG. 2) the indicator line has come back to its original position.

It will be evident that the ratio of armor wires 15 to center conductors 12 may be varied. It will also be evident that the circumferential space 18 which is needed between armor wires will depend in large measure upon the diameter of the roll 30 into which the wire must be coiled. The smaller the diameter of roll 30, the greater is the amount of the twist in the cable per unit of its length, and a correspondingly greater circumferential space 18 between armor wires is required. This is a design parameter which can be calculated, and it is preferred that in the twisted condition of the cable as shown in FIG. 6 the diminished space 19 should be measurably greater than zero.

In the cable of FIG. 3 the protective sheath 16 has a cylindrical outer surface, while a number of longitudinal bulges or ridges 16*a* are formed on its inner surface. Each of the bulges or ridges 16*a* occupies a portion of the space that would otherwise exist between two adjacent ones of the armor wires 15. Since the bulges or ridges 16 are equally spaced from each other, they serve to maintain a circumferentially symmetrical arrangement of the armor wires 15. That is, they serve to maintain all of the circumferential spaces 18 between the adjacent armor wires 15 at substantially equal values. Protective sheath 16 is preferably made from either a plasticized nylon or an unplasticized nylon and in either event has some degree of flexibility or resiliency. When the cable is twisted, therefore, the sheath 16 is twisted, and the bulges or ridges 16*a* tend to equalize the diminished spaces 19 between the armor wires. Sheath 16 is preferably extruded around the wires 15, and the materials do not inherently bond to each other, and hence the wires 15 are free to shift either circumferentially or longitudinally relative to the sheath.

ALTERNATE FORM

Figure 7:
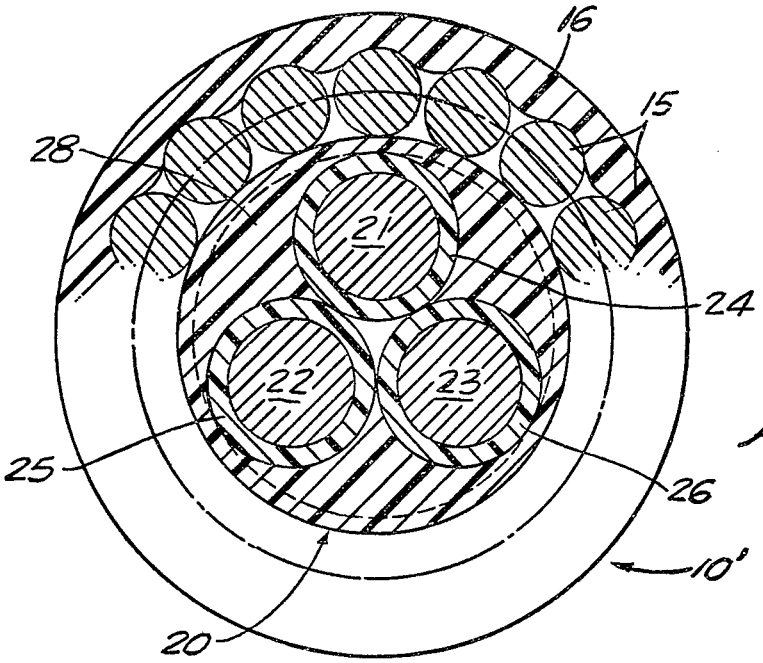
FIG. 7 is a transverse cross-sectional view of an alternate form of the cable construction.
Figure 8:
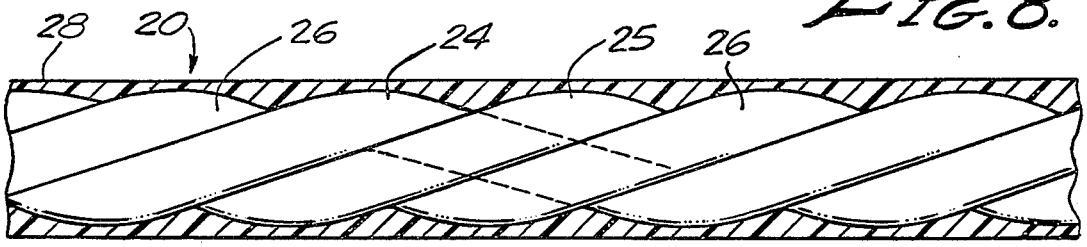
FIG. 8 is a side view, partially in cross-section of the twisted core of the cable of FIG. 7.

Reference is now made to FIGS. 7 and 8 of the drawings which illustrate an alternate form of the invention.

In the cable of FIGS. 7 and 8 the armor wires 15 and protective sheath 16 are the same as previously described. However, the conductive core is constructed in a different manner. Specifically, the conductive core 20 includes three separate metallic conductors 21, 22, 23. These conductors are encased in separate insulation coverings 24, 25, 26, respectively. These insulated conductors are twisted in a helical configuration as best seen in FIG. 8. The space between and around these insulated conductors is filled by a body of insulating material 28, whose outer surface is substantially cylindrical and of the same diameter D as shown in FIG. 4 for the first embodiment of the invention.

The conductive core 20 if used by itself as a cable, would have a significant tendency to twist or untwist as the longitudinal load of tensile stress upon the cable was changed. However, the conductive core 20 when incorporated into cable 10′ of the present invention does not have this tendency. The reason is that the core conductors 21, 22, 23 are preferably made from a rather soft metal, such as, copper which has a fairly high degree of stretchiness or elasticity. Armor wires 15, as previously stated, are made of relatively hard steel and have relatively little tendency to stretch. Therefore, a longitudinal tensile stress load upon the cable 10′ is carried almost entirely by the armor wires 15, and to a very small extent by conducting core 20.

Conducting core 20 therefore has very little tendency to make the cable twist.

OTHER MODIFICATIONS

Figure 9:
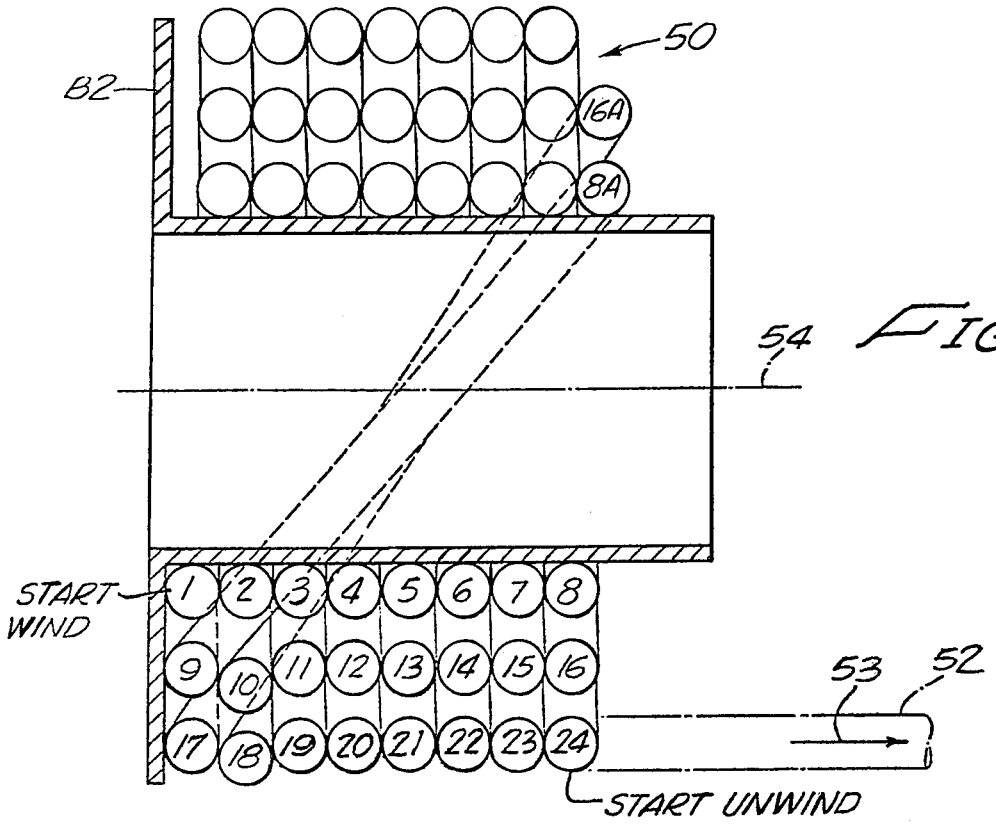
FIG. 9 is a longitudinal cross-sectional view of another cable coil in accordance with the present invention.

FIG. 9 illustrates another arrangement for coiling and uncoiling the cable. In FIG. 9 a cable roll 50 is supported on a base B2. The base B2 is a drum having a flange on one end. The inner end 1 of the cable is placed on the drum surface adjacent the flange, where the legend "start wind" appears. The cable is wound around the drum to provide successive loops in a first layer, the loops being numbered 1 through 8, inclusive. Then the end of loop 8 (designated in the upper right portion of FIG. 1 as 8A) is carried back over the upper surface of the starting end 1, forming the beginning point 9 of a second layer. The second layer includes loops 9 through 16, inclusive. The end of loop 16 (designated 16A) is carried over the end 9 to form a new starting point 17 for a third layer of the roll. Then loops 17 through 24, inclusive, are placed on the third layer. Free end 52, shown in dotted lines, is the loop end 24, which is grasped and pulled in a direction 53 (arrow) which is parallel to the longitudinal axis of the roll (dotted line 54). As in the illustration of FIGS. 1 and 2, the free or delivered end is pulled straight out without any concurrent rotation, but this results in untwisting the cable approximately 360° for each loop that is pulled off the roll.

Figure 10:
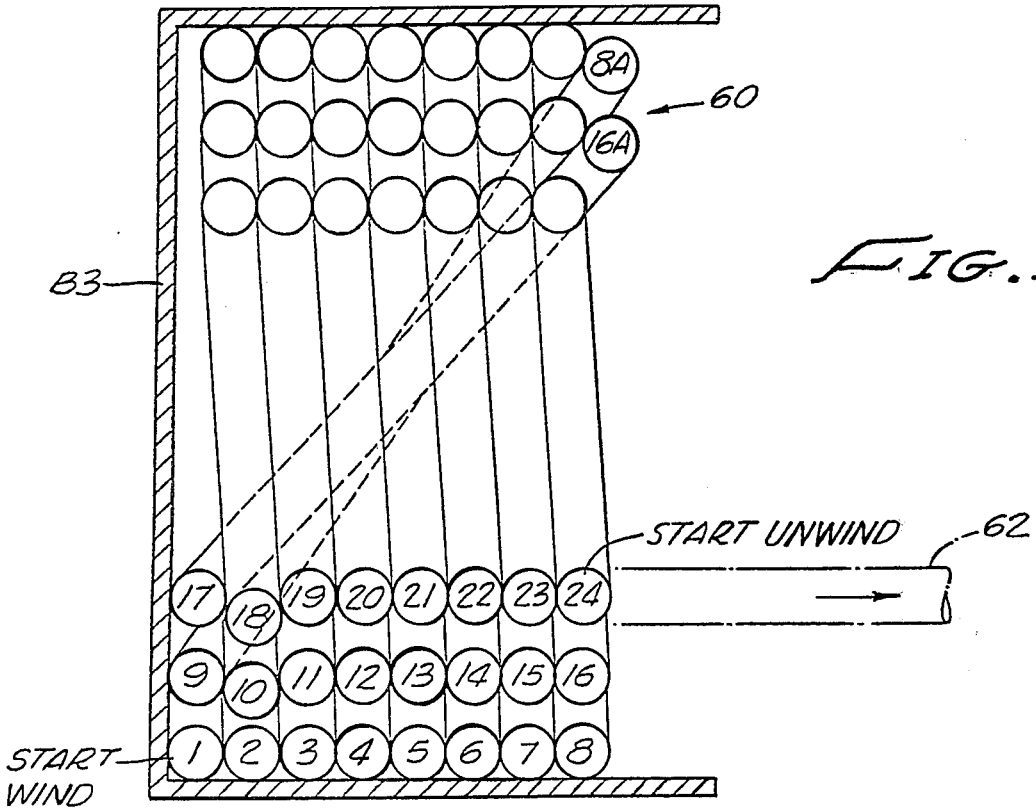
FIG. 10 is a longitudinal cross-sectional view of still a third cable coil in accordance with the invention.

Another cable roll 60 is shown in FIG. 10, supported by a base B3 which has the form of a tub or a can. Here the outside layer of the coil is wound first, and the inside layers subsequently. The unwinding operation from free end 62 is started from the last inside layer.

Figure 11:
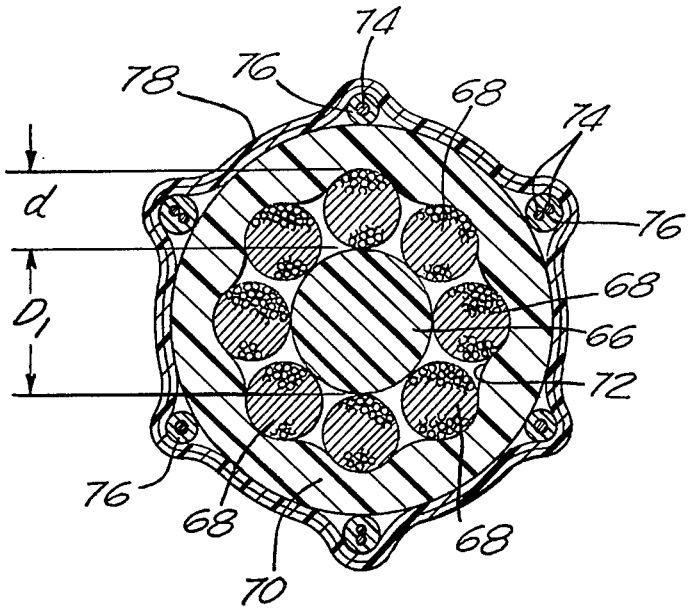
FIG. 11 is a cross-sectional view of a further embodiment of the cable in accordance with the present invention.
Figure 12:
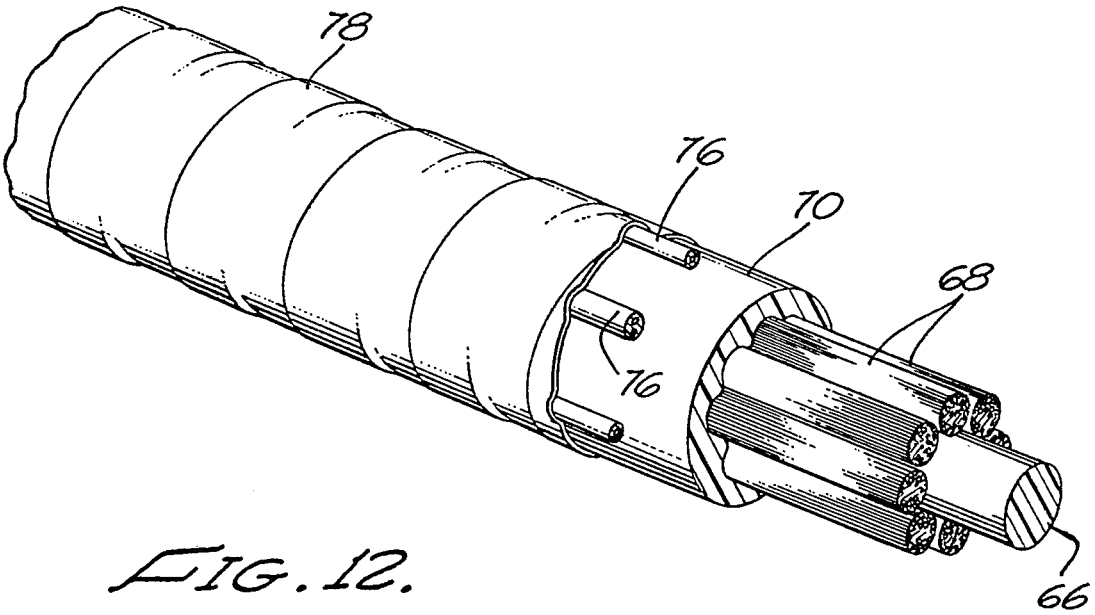
FIG. 12 shows a pictorial view of the cable of FIG. 11, with portions cut away to expose the inside cable elements.

The embodiment of the invention shown in FIGS. 11 and 12, illustrates a core member 66 of a thermoplastic of the class mentioned with respect to the first embodiment shown in FIG. 1.

Surrounding the core member 66 and constituting a part of the inner core of the cable are a plurality of bundles 68 composed of discrete filaments or fibers stranded together and made of a high tensile material of the class mentioned in the Summmary of Invention. As seen in FIG. 12, the individual fibers of the bundles 68 lie straight and parallel to each other.

As shown, the bundles 68 are circumferentially spaced around the core member 66 and as illustrated in FIG. 12 extend longitudinally of the cable axis, parallel relative thereto and to one another. The preferred spacing between adjacent bundles of strain members which in FIG. 11, for illustration purposes only, is slightly exaggerated, is at least one percent (1%) of the diameter of an individual bundle of fibers.

Enclosing the strain member bundles 68 in close, intimate relationship, is a thermoplastic layer 70 made of a material similar to the thermoplastic utilized for the core member 66.

As in the first embodiment, the layer 70 is disposed generally about the outer surface of the bundles of fibers 68 and does not reach the periphery of the core member 66 via the spacings 72 between the adjacent bundles. The strain members or armor elements are free to shift their positions, as in prior embodiments.

To complete the cable, a plurality of electrical conductors 74, with or without individual insulation 76, is peripherally arranged about the thermoplastic layer 70. A protective sheath 78, is, finally, provided about the conductor elements 74 to retain the latter in position. The protective sheath 78 may be in the form of a suitable thermoplastic material similar to that used for the core member 66 or may be a layer of individual wrappings.

In all other respects, the cable is deployable in identical fashion as its counterparts described relative to the preceding embodiments.

As will be appreciated, the size of the cable is controllable and determined essentially by the number of conductors or pairs of conductors to be included. The conductors shall be positioned as a type of layer extending along the exterior wall of thermoplastic layer 70. Therefore, the layer 70 has to be selected to permit assembly thereon of the desired number of conductors, preferably, to form a spaced layer thereon.

Figure 13:
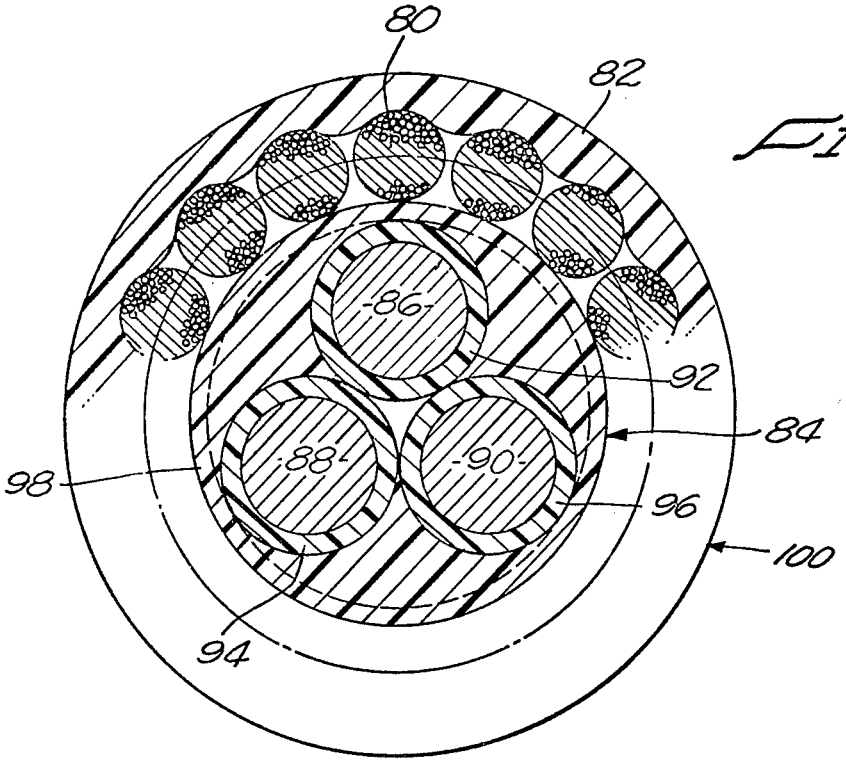
FIG. 13 is a transverse cross-sectional view of yet another alternate form of cable construction according to the invention.
Figure 14:
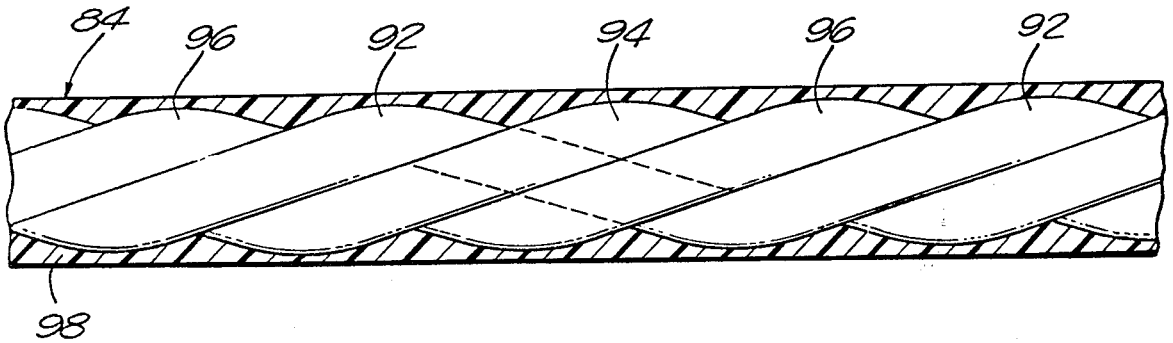
FIG. 14 is a side view, partially in cross-section of the twisted core of FIG. 13.

Reference is now made to FIGS. 13 and 14 of the drawings which illustrate an alternate form of the invention.

In the cable of FIGS. 13 and 14 the armor elements or strain members 80 and the protective sheath 82 are the same as previously described with respect to FIGS. 11 and 12. When the cable is twisted the strain members are able to shift their positions within the sheath. However, the conductive core 84 is constructed in a different manner. Specifically, the conductive core includes three separate metallic conductors 86, 88, 90. These conductors are encased in separate insulation coverings 92, 94, 96 respectively. These insulated conductors are twisted in a helical configuration as best seen in FIG. 14. The space between and around these insulated conductors is filled by a body of insulating material 98 whose outer surface is substantially cylindrical and of the same diameter D as shown in FIG. 4 for the first embodiment of the invention.

The conductive core 84 if used by itself as a cable, would have a significant tendency to twist or untwist as the longitudinal load of tensile stress upon the cable was changed. However, the conductive core 84 when incorporated into the cable of FIG. 13 of the present invention, does not have this tendency, the reason being that the core conductors 86, 88, 90 preferably are made from a rather soft metal, such as copper, which has a fairly high degree of stretchiness or elasticity. The strain members 80 as previously stated, are in the form of individual bundles of discrete fibers or strands of high tensile strength and of a material used for the prior embodiment and which have relatively little tendency to stretch. Therefore, a longitudinal tensile stress load upon the cable 100 of FIG. 13 is carried almost entirely by the strain members 80, and the sheath 82. The conducting core 84 therefore, has very little tendency to make the cable twist.

Figure 15:
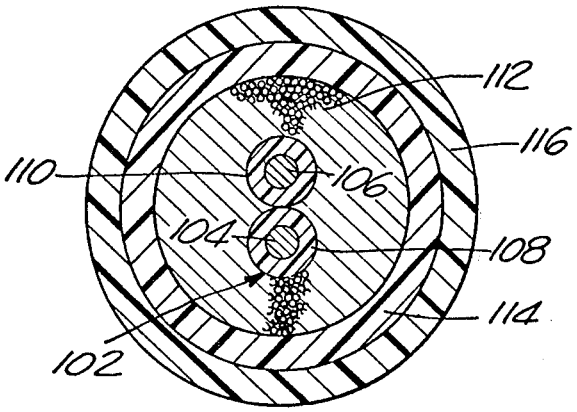
FIG. 15 is a transverse cross-sectional view of yet a further alternate form of cable construction in accordance with the invention.

Having reference now to FIG. 15 of the drawings, there is shown a cable core indexed generally as 102. The core 102 is seen to comprise a pair of electrical conductors 104, 106 provided with individual insulation 108, 110. Embracing the conductors in surrounding relationship and forming an annulus thereabout are a plurality of fibrous reinforcement or strain members 112, preferably consisting of hundreds of small fibers. The strain members 112 extend along a path generally in parallelism with the longitudinal axis of the cable. The fiber elements 112 are made of a material or compositions thereof of high tensile strength similar to those described with respect to the embodiments shown in FIGS. 13 and 14. The overall radial thickness of the strain members could be either smaller or larger than the overall diameter of the insulated core 102.

Enclosing the inner core 102 and strain members 112 is a double insulated jacket composed of an inner nonplastic layer 114 and an outer plasticized coating 116.

The need for the present invention has arisen in conjunction with cable that is deployed in the ocean. However, the invention provides a novel interrelationship between the cable structure and the method of deployment or paying out thereof, and hence there is every reason to believe that the invention will have utility and value in many and diverse other applications.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A coiled electromechanical cable adapted for deployment in an untwisted state along a generally straight path and when thus deployed to be substantially free of twisting movements resulting from changes in the longitudinal tensile load upon the cable, the cable including a conducting core, a plurality of fibrous armoring elements arranged circumferentially around the core, and a sheath of protective material encompassing the armoring elements; the cable being arranged such that when it lies straight and untwisted said fibrous armoring elements extend generally parallel to one another and to the longitudinal axis of the cable and are circumferentially spaced apart a sufficient distance to permit the cable to be twisted when it is rolled; the cable being coiled into a roll with approximately 360° of twist in the cable within each complete loop of the roll.

2. The electromechanical cable as claimed in claim 1, wherein said plurality of fibrous armoring elements are in the form of a multitude of discrete fibers of high tensile strength stranded together into a plurality of bundles.

3. The electromechanical cable as claimed in claim 1, wherein said plurality of fibrous armoring elements are made of graphite.

4. The electromechanical cable as claimed in claim 1, wherein said plurality of fibrous armoring elements are made of polyester.

5. The electromechanical cable as claimed in claim 1, wherein said plurality of fibrous armoring elements are made of glass.

6. The electromechanical cable as claimed in claim 1, wherein said plurality of fibrous armoring elements are made of nylon.

7. The electromechanical cable as claimed in claim 1, wherein said sheath is made of a thermoplastic material.

8. A plastic-sheathed, antitorsional armored electromechanical cable having a high tensile strength, said cable comprising a cable core having at least one conductive element, a plurality of flexible armoring elements surrounding said core and having outer exposed surfaces and a sheath of deformable, dielectric plastic material superimposed onto said armoring elements at said exposed surfaces thereof, said armoring elements being arranged in an annular configuration and being disposed in adjacent, parallel relation to one another and to the main axis of the cable, and said sheath being disposed such that said armoring elements are retained in contact with said core with at least some of said armoring elements being circumferentially spaced apart from one another to provide void spaces to facilitate the armoring elements assuming a substantially helical path about the axis of the core when the cable is twisted.

9. An electromechanical cable as claimed in claim 8, wherein said armoring elements are circumferentially spaced from one another by at least 1% of the diameter of the armoring elements.

10. An electromechanical cable as claimed in claim 8 wherein said armoring elements are made of fibrous material.

11. An electromechanical cable as claimed in claim 8 wherein said armoring elements are steel wires.

12. An electromechanical cable as claimed in claim 8 wherein said armoring elements are in the form of a plurality of bundles of discrete filaments having a high tensile strength.

13. An electromechanical cable as claimed in claim 8, wherein said sheath is made of a thermoplastic material.

14. An electromechanical cable deployable in no-torque condition, said cable comprising an inner cable core including a plurality of straight fibers of high tensile strength, disposed longitudinally and parallel relative to each other and the main axis of said cable, said fibers being loosely confined in an open cavity extending longitudinally of said cable core, whereby said fibers are free to shift their positions relative to each other and to said axis when the cable is twisted, a plurality of electrically conductive elements surrounding said inner cable core, and an insulating protective layer enclosing said electrically conductive elements.

15. An electromechanical cable of the type deployable without torque effects, said cable comprising an inner cable core having a main axis, a plurality of flexible armoring elements of high tensile strength disposed in an annular arrangement about said axis, being normally parallel to each other and to said axis, at least some of said armoring elements having circumferential spaces therebetween, a protective layer of plastic material disposed annularly about said armoring elements, the inner surface of said protective layer of plastic material and the outer surface of said core forming an annular cavity within which said armoring elements are able to easily move circumferentially relative to each other and to said axis when the cable is twisted, a plurality of electrically conductive members arranged circumferentially about said layer, and a cover disposed about said electrically conductive members.

16. The electromechanical cable as claimed in claim 15, wherein said armoring elements are in the form of a plurality of bundles of discrete fibers having a high tensile strength.

17. The electromechanical cable as claimed in claim 16, wherein said protective layer is a thermoplastic material made of polyurethane.

18. The electromechanical cable as claimed in claim 15, wherein said protective layer is a thermoplastic material made of extruded nylon.

19. The electromechanical cable as claimed in claim 15, wherein said inner cable core is made of polyurethane.

20. A coiled electromechanical cable adapted for deployment along a generally straight path and when thus deployed to be substantially free of twisting movements resulting from changes in the longitudinal tensile load upon the cable, comprising:

a cable which is its uncoiled state includes
a. an insulated conducting core
b. a plurality of untwisted steel armor wires arranged in parallel relationship to each other and to the axis of said core, and
c. a sheath of protective material encompassing said armor wires, at least some of said armor wires being then spaced circumferentially apart;
said cable being coiled into a roll with approximately 360° of twist in the cable within each complete loop of the roll;
whereby a free end of the cable may be pulled from the roll without any concurrent rotation of the free end relative to the roll to thereby cause the cable to untwist as it is paid out from the roll and deployed along a generally straight path.

21. An anti-torsional electromechanical cable comprising:
a conducting core;
a plurality of strain members circumferentially arranged about said core and normally extending parallel to each other as well as to the longitudinal axis of the cable; and
means confining said strain members within said circumferential arrangement;
said strain members being free to shift their positions relative to said axis whenever the cable is either twisted or untwisted;
whereby said cable may be first twisted and then untwisted during its deployment, and after its deployment is capable of carrying a varying longitudinal tensile load without appreciable twisting or kinking.

22. The cable of claim 21 wherein said confining means is a cylindrical housing made of flexible material.

23. In an electromechanical cable adapted to be deployed in a no-torque condition, said cable comprising a conductive core, a plurality of strain members of substantial tensile strength arranged circumferentially relative to the longitudinal axis of said cable and normally extending straight and parallel to each other and to said axis when the cable is free of any twist, and a sheath surrounding said strain members, said strain members being sufficiently loosely disposed and movable relative to each other within said sheath so that they may temporarily shift their positions relative to said axis during twisting of said cable and will then resume their original positions when the cable is untwisted.

24. An electromechanical cable comprising a flexible plastic sheath, said sheath enclosing a plurality of armor elements of high tensile strength and at least one insulated electrical conductor adjacent said armor elements, said armor elements being freely disposed within said sheath annularly and parallel relative to the main axis of said cable, so as to be easily shiftable relative to said axis during twisting and untwisting of said cable whereby the twisting or untwisting of said cable may be achieved with relatively low torque and said cable when deployed in an untwisted state has substantially no self-induced torque that would tend to produce twisting and kinking thereof.

25. A coiled electromechanical cable surfaces for deployment in an untwisted state along a generally straight path and when thus deployed to be substantially free of twisting movements resulting from changes in the longitudinal tensile load upon the cable, the cable including a conducting core, a plurality of steel armor wires arranged circumferentially around the core, and a sheath of protective material encompassing the outermost surface only of said armor wires; the cable being coiled into a roll with approximately 360° of twist in the cable within each complete loop of the roll; and the cable being characterized by the fact that when it lies straight and untwisted said armor wires extend parallel to the longitudinal axis of the cable and are circumferentially spaced apart a sufficient distance to permit the cable to be twisted when it is rolled.

26. A coiled electromechanical cable adapted for deployment along a generally straight path and when thus deployed to be substantially free of twisting movements resulting from changes in the longitudinal tensile load upon the cable, comprising:
a. an insulated conducting core,
b. a plurality of armoring elements arranged annularly about said core and normally untwisted in parallel relation to each other and to the axis of the core, at least some of said elements being spaced circumferentially apart, and
c. a sheath of plastic protective material encompassing said armoring elements;
the inner surface of said sheath and the outer surface of said core forming a generally annular cavity within which said armoring elements are free to move, so that when the cable is pretwisted approximately 360° for each complete revolution of the coil into which the cable is wound, said armoring elements then assume a substantially helical path about the axis of the core;
whereby the twisting of the cable as it is pulled off the coil neutralizes the pretwist provided in the cable so that the cable is deployed in an untwisted condition.

27. In an electromechanical cable adapted to be pretwisted and coiled into a roll, and to be subsequently paid out from the roll without rotation of the delivered end so as to then assume an untwisted state, the combination comprising:
means providing a generally annular space extending longitudinally of said cable;
at least one conductive element embedded in said means; and
a plurality of longitudinally extending strain members formed of a material having a high modulus of elasticity and arranged circumferentially about the axis of said cable within said space and being loosely confined therein, said strain members being able to reorient themselves between straight positions in which they lie parallel to each other and to the cable axis when the cable is in an untwisted state, and helical positions when the cable is in a twisted state;
whereby when a varying tensile load is imposed upon said cable in an untwisted state, the variations of tensil stress within said strain members have a minimal tendency to cause said cable to twist.

28. An electromechanical cable adapted to be pretwisted and wound into a coil, to subsequently be paid out from the coil and concurrently untwisted, and thereafter to lie in an untwisted and torque-free state under conditions of varying tensile load, said cable comprising:
at least one electrical conductor;

a plurality of strain members having a high modulus of elasticity for providing tensile support of said conductor; and cover means enclosing said conductor and strain members;

said cable being characterized by having a generally annular space extending longitudinally thereof, said strain members extending longitudinally within said space in circumferentially arranged relationship about the axis of said cable and being loosely confined therein;

said strain members being able to reorient themseleves between helical positions when the cable is in a twisted state, and straight positions in which they lie parallel to each other and to the cable axis when the cable is in an untwisted state.

29. A cable wound in a coil while in a twisted state such that it can be deployed from the coil free of any twist, said cable comprising:

a cable core having a longitudinal axis, a plurality of longitudinally extending strain members having a high modulus of elasticity and disposed in spaced relation about the outer surface of said core, and a cable sheath surrounding said strain members, said cable being so constructed and arranged that when it is straight and untwisted said strain members extend parallel to one another and to the cable axis and when it is twisted said strain members physically reorient themselves helically about the cable axis.

30. In an electromechanical cable adapted to be wound into a coil while the cable is twisted about its axis such that the cable can be subsequently paid from the coil in an untwisted and torque-free state, the combination comprising:

means providing a generally annular space extending longitudinally of said cable, a plurality of longitudinally extending strain members formed of a material having a high modulus of elasticity and being retained within said annular space to permit relative circumferential movement therein, and at least one electrically conductive element secured on said means, said strain members being disposed in said annular space so as to be straight and parallel to one another and to the axis of the cable when the cable is in an untwisted state, and said strain members being able to physically adjust themselves in said annular cavity helically about the axis of said cable without substantial elastic deformation when the cable is twisted.

31. In an electromechanical cable adapted to be twisted about its longitudinal axis and wound into a coil so that it can be subsequently paid out from the coil in an untwisted and torque-free state, the combination comprising:

flexible means providing a cavity extending longitudinally of said cable, and at least one insulated electrical conductor and a plurality of longitudinally extending strain members enclosed in said cavity, said strain members formed of a material having a high modulus of elasticity and being loosely arranged within said cavity and extending parallel to each other and to the axis of the cable when the cable is in an untwisted state free of torsional strain, and said strain members becoming helically disposed about said longitudinal axis when the cable assumes a twisted state and induces a torsional strain in said flexible means, whereby as the cable is paid out from the coil and untwists, the torsional strain on said flexible means is relieved and said strain members return to their positions extending parallel to each other and to the axis of the cable.

32. In an electromechanical cable adapted to be twisted about its longitudinal axis and wound into a coil such that it can be subsequently paid out from said coil in an untwisted and torque-free state, the combination comprising:

retaining means providing a generally annualar space extending longitudinally of said cable, at least one conductive element held by said retaining means, and a plurality of longitudinally extending strain members formed of a material having a high modulus of elasticity and confined within said annular space but free to move circumferentially or longitudinally therein, said strain members normally extending parallel to each other and to the axis of the cable when the cable is in an untwisted torsion-free state, and said strain members being able to physically reorient themselves within said annular space helically about the axis of the cable when the cable is twisted, a torsional strain then being induced in said retaining means.

33. A cable structure comprising:

a cable core including at least one electrical conductor, a plurality of relatively stiff strain members arranged annularly in a spaced relationship about the cable core, and a sheath enclosing the strain members, said strain members being normally disposed between the surfaces of said cable core and said sheath so as to be straight and parallel to one another and to the axis of the cable when the cable is an untwisted state, and wherein the materials of said cable core and said sheath are selected in conjunction with the material of the strain members such that when said cable is twisted said strain members are able to readily physically adjust themselves between the surfaces of said cable core and said sheath to assume a helical orientation about the axis of the cable without substantial torsional stresses being induced therein.

34. In an electromechanical cable adapted to have a pretwist about its axis and to be wound into a coil such that the cable can be subsequently paid out from the coil in an untwisted and torque-free state, the combination comprising:

a conducting core, a plurality of armoring elements arranged about said core, a cable outer sheath which together with the cable core forms an annular cavity in which said armoring elements are retained, said armoring elements being normally oriented in said annular cavity parallel to each other and the axis of the cable when the cable is untwisted, whereby when the cable is pretwisted at the time the cable is wound the armoring elements are angularly disposed in the annular cavity to take on a substantially helical orientation with respect to the axis of the cable, and when the cable is paid out from the coil the armoring elements are again returned to an orientation parallel to each other and to the axis of the cable.

35. An electromechanical cable adapted to be wound into a coil with the cable having a pretwist about its axis such that the cable can be subsequently paid out from the coil in an untwisted and torque-free state, comprising:

a cable core formed of a material having a relatively low modulus of elasticity, a plurality of armoring elements have a relatively high modulus of elasticity arranged about said cable core, a cable outer sheath formed of a material having a relatively low modulus of elasticity, said sheath together with said core forming an annular cavity which encloses said armoring elements, said armoring elements being normally oriented in said annular cavity parallel to each other and to the axis of the cable when the cable is untwisted, and at least one electrically conductive element held by said material having a relatively low modulus of elasticity, whereby when the cable is pretwisted and wound into the coil the armoring elements are angularly disposed in the annular cavity to take on a helical orientation with respect to the axis of the cable with substantially all the torsional stress in the cable being induced in the core and the sheath, and when the cable is untwisted upon being paid out from the coil for supporting a tensile load the armoring elements are again returned to an orientation parallel to each other and to the axis of the cable with substantially all the tensile stress on the cable due to the load being induced in the armoring elements.

36. The method of dispensing an electromechanical cable so that after its deployment it is substantially torque-free when subjected to changing longitudinal tensile loads, comprising the steps of:

selecting the cable to have a plurality of strain members which are circumferentially arranged within a generally annular space and are normally disposed straight and parallel to each other and to the axis of the cable, and also to have means loosely confining said strain members within said annular space so that they are free to reorient themselves from straight to helical positions when the cable is twisted;

winding said cable into a coil and concurrently pretwisting its approximately 360° per loop of the coil; and then pulling the cable off the coil without relative rotation between the delivered cable end and the coil, so that the pretwist is relieved.

* * * * *

UNITED STATES PATENT OFFICE

CERTIFICATE OF CORRECTION

Patent No. 4,006,289 Dated February 1, 1977

Inventor(s) Norman P. Roe et al.

It is certified that error appears in the above-identified patent and that said Letters Patent are hereby corrected as shown below:

Column 2, line 33, change "Development" to --Deployment--.

Column 3, line 39, after "confined therein so" change the word "they" (first occurrence) to --that--.

Column 4, line 10, delete "revolution".

Column 11, line 64, (the first line of Claim 25), change "surfaces" to --adapted--.

Column 12, line 4, change "surface" to --surfaces--.

Column 14, line 15, correct the word "annualar" to read --annular--.

Column 14, line 42, after "when the cable is" insert --in--.

UNITED STATES PATENT OFFICE

CERTIFICATE OF CORRECTION

Patent No. 4,006,289 Dated February 1, 1977

Inventor(s) Norman P. Hoe et al.

It is certified that error appears in the above-identified patent and that said Letters Patent are hereby corrected as shown below:

Column 16, line 24, after "twisting" change "its" to --it--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*